US008021035B2

(12) United States Patent
Anglikowski et al.

(10) Patent No.: US 8,021,035 B2
(45) Date of Patent: Sep. 20, 2011

(54) SURFACE-MOUNTABLE LIGHT FIXTURE HAVING AN ACCESS PORT AND CORRESPONDING METHOD AND KIT

(75) Inventors: Ronald Edward Anglikowski, Bowling Green, KY (US); David Scott Bullard, Bowling Green, KY (US); William Calvin Raper, Sparta, TN (US); Jeremy Lee Prichard, Cave City, KY (US)

(73) Assignee: HeathCo LLC, Bowling Green, KY (US)

( * ) Notice: Subject to any disclaimer, the term of this patent is extended or adjusted under 35 U.S.C. 154(b) by 243 days.

(21) Appl. No.: 12/059,521

(22) Filed: Mar. 31, 2008

(65) Prior Publication Data

US 2009/0244926 A1 Oct. 1, 2009

(51) Int. Cl.
*F21S 8/04* (2006.01)

(52) U.S. Cl. ..... 362/655; 362/147; 362/148; 362/145; 362/404; 362/368

(58) Field of Classification Search ..... 362/655, 362/147, 148, 145, 375, 404, 432, 645, 396, 362/368; 318/90
See application file for complete search history.

(56) References Cited

U.S. PATENT DOCUMENTS

| | | | | |
|---|---|---|---|---|
| 3,187,170 | A * | 6/1965 | Kille | 362/6 |
| 3,250,912 | A * | 5/1966 | Van Steenhoven | 318/90 |
| 3,594,568 | A * | 7/1971 | Guth, Jr. | 362/221 |
| 4,433,366 | A * | 2/1984 | Wade | 362/267 |
| 5,662,407 | A * | 9/1997 | Fischer et al. | 362/147 |
| 6,095,660 | A * | 8/2000 | Moriyama et al. | 362/147 |
| 6,682,303 | B2 * | 1/2004 | Wu | 416/5 |
| 2007/0105414 | A1 | 5/2007 | Kohen | |

FOREIGN PATENT DOCUMENTS

DE NL 164148 B * 6/1980

* cited by examiner

*Primary Examiner* — Sharon Payne
(74) *Attorney, Agent, or Firm* — Fitch Even Tabin & Flannery

(57) ABSTRACT

A surface-mountable light fixture (100) can comprise a base (101) that is configured and arranged to be mounted in an installed position juxtaposed against a mounting surface (102). At least one light source interface (109, 110) that requires mains electricity is contained within this base. This base further comprises an access port (111) formed therein which, when opened while the base is mounted in an installed position on the mounting surface, provides end user access to electrical conductors for the light source interface(s) as well as the mains electricity (104, 105). This base then also further comprises a lockable cover (112) that is configured and arranged to selectively and reversibly seal the access port to deny end user access to the electrical conductors.

29 Claims, 4 Drawing Sheets

SURFACE-MOUNTABLE LIGHT FIXTURE HAVING AN ACCESS PORT AND CORRESPONDING METHOD AND KIT

TECHNICAL FIELD

This invention relates generally to surface-mountable light fixtures.

BACKGROUND

Surface-mountable light fixtures of various kinds are known in the art. As used herein, this reference to "surface-mountable" refers to light fixtures that mount to any of a variety of (typically horizontal or vertical) mounting surfaces other than the ground. This reference will also be understood to refer to light fixtures that, unless mounted to the surface, will not remain in an installed position on that surface as gravity alone will cause the light fixture to fall from that position.

Installing such a surface-mountable light fixture typically entails two primary tasks; coupling the light fixture to mains electricity and physically securing the light fixture to the surface. A typically designed surface-mountable light fixture essentially requires that these two tasks be accomplished in the order presented above. This is so because physically attaching the light fixture to the surface inherently blocks access to the wiring. This, in turn, makes it impossible to couple the light fixture to the mains electricity once the light fixture has been installed on the surface.

This design approach, however, often presents a considerable installation challenge. In particular, it can be cumbersome to hold the light fixture in sufficient proximity to its installed location prior to such installation in order to permit the light fixture's wiring to be connected to the wiring for the mains electricity. This is owing to a variety of salient factors including, but not necessarily limited to, the weight of the light fixture, the form factor of the light fixture, the fact that installation often occurs at an elevated height and the installer may be balancing themselves on a ladder, the fact that the installer only has, at most, two arms/hands, and so forth.

A variety of work-around solutions have been proposed to attempt to meet this need. In general, these solutions tend to provide some supplemental mechanism to temporarily hold the light fixture in a position that is proximal to, but not equal to, an installed position in order to permit the installer to then use both of their hands to make the required electrical connections. Various hooks, for example, have been suggested for use in this regard.

Unfortunately, such proposals do not necessarily meet the needs of all application settings. For example, these solutions, by definition, provide only for a temporary holding of the light fixture. Once the electrical coupling is completed, the temporary holding mechanism must be removed and/or disengaged and the light fixture then affixed in an installed position. Mishaps can occur during this activity in part because of the previously established electrical connections. These connections can sometimes impair properly positioning the light fixture in the installed position, for example.

BRIEF DESCRIPTION OF THE DRAWINGS

The above needs are at least partially met through provision of the a surface-mountable light fixture having an access port and corresponding method and kit described in the following detailed description, particularly when studied in conjunction with the drawings, wherein.

Figure 1:
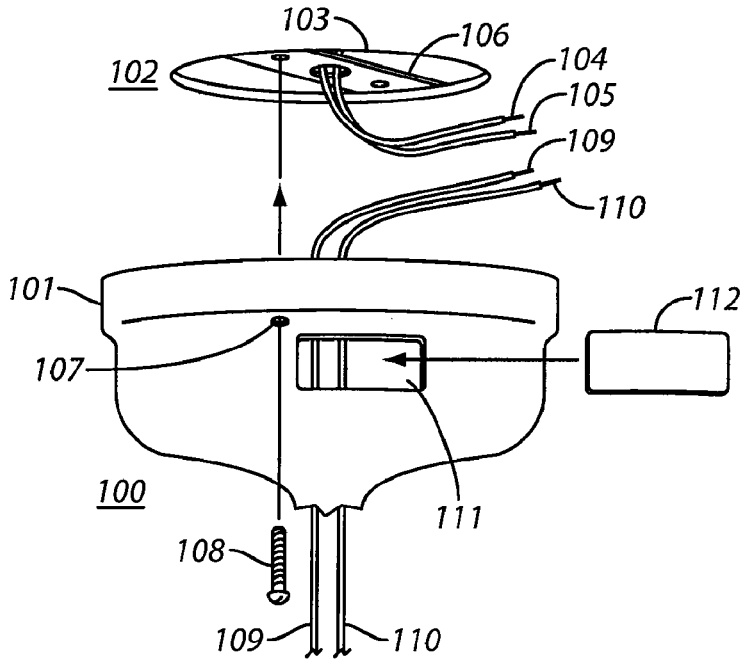
FIG. 1 comprises a perspective view as configured in accordance with various embodiments of the invention.

Skilled artisans will appreciate that elements in the figures are illustrated for simplicity and clarity and have not necessarily been drawn to scale. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention. It will further be appreciated that certain actions and/or steps may be described or depicted in a particular order of occurrence while those skilled in the art will understand that such specificity with respect to sequence is not actually required. It will also be understood that the terms and expressions used herein have the ordinary technical meaning as is accorded to such terms and expressions by persons skilled in the technical field as set forth above except where different specific meanings have otherwise been set forth herein.

DETAILED DESCRIPTION

Generally speaking, pursuant to these various embodiments, a surface-mountable light fixture can comprise a base that is configured and arranged to be mounted in an installed position juxtaposed against a mounting surface. At least one light source interface that requires mains electricity is contained within this base. This base further comprises an access port formed therein which, when opened while the base is mounted in an installed position on the mounting surface, provides end user access to electrical conductors for the light source interface(s) as well as the mains electricity. This base then also further comprises a lockable cover that is configured and arranged to selectively and reversibly seal the access port to deny end user access to the electrical conductors.

By one approach, this lockable cover has a tool interface and is sealed and unsealed only through the use of a corresponding tool. By another approach, this lockable cover comprises a hand-manipulable interface such that the lockable cover can be manipulated to seal and unseal the access port by hand (that is, without use of a tool).

So configured, this surface-mountable light fixture will support an installation procedure that permits the light fixture to be installed prior to coupling the light fixture to the mains electricity. Once installed, the wiring can then be appropriately coupled via the access port following which the access port can be closed to thereby provide protection from exposure to the mains electricity. These teachings will further readily accommodate providing instructions in this regard to the installer using any of a variety of informational delivery modalities.

By permitting the light fixture to be physically installed prior to effecting the electrical wiring requirements of completing that installation, essentially all of the difficulties presented by prior art approaches in this regard are avoided or at least significantly mitigated. These skilled in the art will recognize that these teachings are highly flexible in application and will accommodate a broad range of light fixture form factors, weights, and other points of differentiation. It will further be appreciated that these teachings can be readily applied in conjunction with traditional mounting apparatus and techniques and requires no special installation or mounting requirements in this regard.

These and other benefits may become clearer upon making a thorough review and study of the following detailed description. Referring now to the drawings, and in particular to FIG. 1, an illustrative example that is compatible with many of these teachings will now be presented.

This illustrative example presents a surface-mountable light fixture 100 comprising a base 101 that is configured and arranged to be mounted in an installed position juxtaposed against a mounting surface 102. Only a portion of this base 101 is illustrated for the sake of clarity and those skilled in the art will recognize that the illustrated form factor of this base 101 is essentially fanciful and arbitrary and that these teachings will accommodate a base having essentially any form factor of choice.

In this illustrative example, the mounting surface 102 comprises the horizontal interior (or exterior) ceiling or eave of a manmade structure such as a building. Those skilled in the art will recognize that this mounting surface can also comprise, as appropriate, a vertical surface such as an interior or exterior wall or the like. Consistent with the meaning of the expression "surface mountable" presented above, the light fixture 100 cannot be maintained in an installed location on such mounting surfaces by gravity alone; instead, the light fixture 100 must be attached in some additional way in order to maintain such a disposition.

This reference to an "installed position" will also be understood to refer to the attachment of the light fixture 100 to the mounting surface 102 in accordance with the design of the light fixture 100 and in a manner whereby the functional and aesthetic characteristics as intended by the manufacturer are fully met. This does not require that the light fixture 100 be genuinely permanently affixed in such a position; indeed, in most cases, the installation is intentionally left reversible to permit maintenance and replacement as desired. This meaning of "installed position," however, does encompass the notion that no further physical manipulations of the light fixture 100 or its components with respect to the mounting surface 101 are anticipated or necessary in order to effect the installed operability of the light fixture 100.

In this illustrative example the mounting surface 102 has a hole 103 formed therethrough to provide access to two electrical conductors 104 and 105 which provide, in turn, access to mains electricity. (For the sake of simplicity, references herein to electrical conductors will present them as pairs of conductors; those skilled in the art will recognize, however, that other numbers of conductors can be used, as when a third conductor serves to provide a direct electrical connection to ground. Accordingly, all such references to "two electrical conductors" can be read as referring to "at least two electrical conductors.") As used herein, the expression "mains electricity" will be understood to refer to a standard source of alternating current. In the United States this typically comprises 120 volt alternating current (at 60 Hertz) while many other places in the world provide, for example, 240 volt alternating current (at 50 Hertz). Such sources and the nature of such electricity comprises an extremely well understood area of endeavor and requires no further elaboration here.

A mounting bracket 106 having holes (including threaded holes) formed therethrough is disposed within this hole 103 and provides a means by which the base 101 can be attached to the mounting surface 102 while positioned proximally thereto. This can comprise, as illustrated, attaching the base 101 to the mounting bracket 106 using threaded members 108 (with only one such threaded member being visible in FIG. 1 for the sake of simplicity and clarity) that pass through a corresponding hole 107 in the base 101. Such mounting mechanisms are very well known in the art. Those skilled in the art will recognize that other possibilities and mounting mechanisms exist in this regard as well with yet others likely to be developed going forward.

In this illustrative example the surface-mountable light fixture 100 further comprises at least one light source interface that is contained (at least in part) within the base 101 and that requires mains electricity. Here, this light source interface comprises a pair of electrical conductors 109 and 110 that, when electrically and physically connected to the corresponding mains electricity conductors 104 and 105, can serve to provide mains electricity to a corresponding light source (not shown). Numerous light sources are known in the art. As these teachings are not overly sensitive to any particular selection in this regard, for the sake of brevity and the preservation of clarity, further elaboration in this regard will not be presented here.

Pursuant to these teachings, the base 101 further comprises an access port 111 and a corresponding lockable cover 112. This access port 111 is formed through the base 101 and is of sufficient size and shape so that, when opened while the base 101 is mounted in the installed position on the mounting surface 102, the access port 111 provides end user access to the aforementioned electrical conductors 104, 105, 109, and 110 for the mains electricity and the light source interface, respectively. By one approach, this access port 111 can be of sufficient size and shape to permit, for example, manipulation of these conductors using the average sized fingers of an average sized adult human in a manner that permits electrically and physically coupling these conductors in order to effect the provision of mains electricity to the light source of the light fixture 100.

Figure 2:
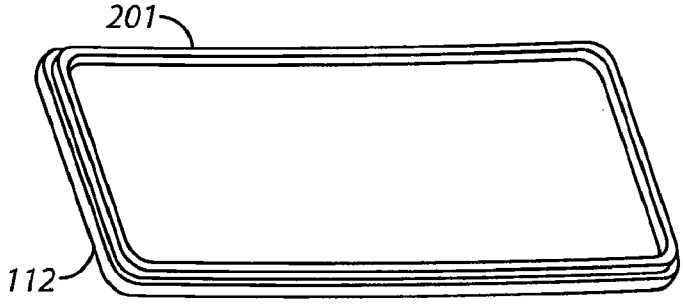
FIG. 2 comprises a perspective view as configured in accordance with various embodiments of the invention.

Referring now to FIG. 2, the lockable cover 112 can have any of a wide variety of form factors. This can include a wide range of tolerated variability with respect to length, width, depth, and shape. Generally speaking, the lockable cover 112 should be of sufficient size and shape to permit selectively and reversibly sealing the access port 111 to thereby deny end user access to any of the aforementioned electrical conductors that are contained within the base 101 or within the aforementioned hole 103.

By one approach, and as shown in FIG. 2, this lockable cover 112 can comprise a seal 201. This seal can comprise, for example, a weatherproof seal. This seal can accordingly comprise a water resistant seal or a waterproof seal if desired. Those skilled in the art will recognize that numerous possibilities in this regard and that the depiction of a seal 201 in FIG. 2 can be viewed both as a realistic depiction of an actual seal and as a schematic representation in this regard. Examples of candidate seals include, but are not limited to, overlap seals, face seals (such as gaskets, O rings, and so forth), interlocking seals, and so forth. Those skilled in the art will understand and recognize that such a seal can be physically present only on the lockable cover 112, or only on the base 101, or on both such components as desired.

Figure 3:
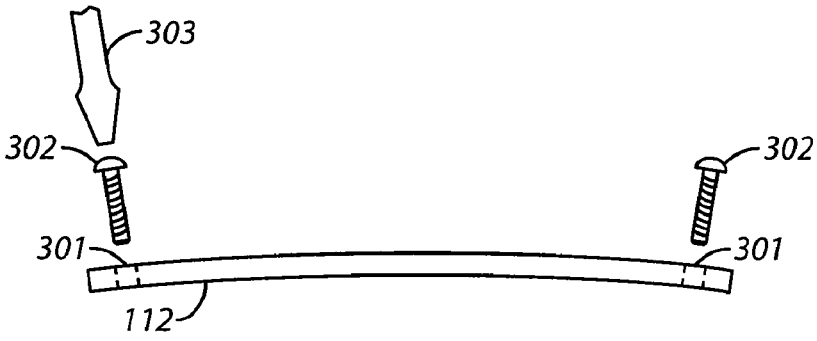
FIG. 3 comprises a side elevational view as configured in accordance with various embodiments of the invention.

As noted, this cover 112 comprises a lockable cover 112. These teachings will accommodate a wide variety of locking mechanisms in this regard. By one approach, and referring now to FIG. 3, the lockable cover 112 can comprise a tool interface such that the lockable cover 112 can only be manipulated to unseal the access port 111 by use of a corresponding tool. In the illustrative example provided, this tool interface comprises holes 301 that are disposed through the cover 112 and which serve to receive threaded members 302 (such as screws or bolts) that serve to secure the cover 112 to the base 101 when appropriately manipulated by a tool such as a screwdriver 303.

Figure 4:
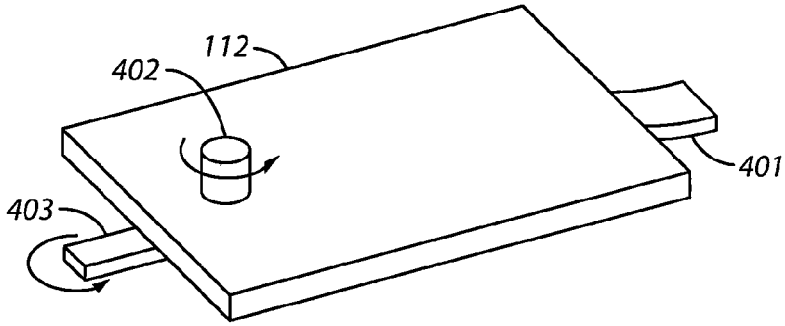
FIG. 4 comprises a perspective view as configured in accordance with various embodiments of the invention.

By another approach, or in combination with the approach just described, the lockable cover 112 can comprise a hand-manipulable interface to permit the lockable cover 112 to be manipulated and thereby unseal the access port 111 by hand (i.e., without the use of tools). With reference to FIG. 4, and by way of example, this lockable cover 112 can have a tab 401 that fits within the interior of the base 101 and a rotating knob 402 that causes a corresponding rotating locking member 403 to rotate between a locked position (shown) and an unlocked position. To illustrate, when placed in the locked position, the rotating locking member 403 will engage an interior surface of the base 101 and hence will prevent removal of the cover 112 from the base 101. By rotating the rotating knob 402, however, the rotating locking member 403 is moved to another position where there is no longer any interaction between the rotating locking member 403 and the interior of the base 101 to thereby permit the cover 112 to be removed from the base 101 and hence expose the access port 111.

Those skilled in the art will recognize and appreciate that such a light fixture 100 can be mounted to the mounting surface 102 in an installed position prior to making any connections between the electrical conductors 104 and 105 for the mains electricity and the electrical conductors 109 and 110 as comprise the light source interface. Following installation, the appropriate connections between these electrical conductors can be made via the access port 111. The cover 112 can then be locked in place to thereby discourage casual human access and exposure to the mains electricity.

Figure 5:
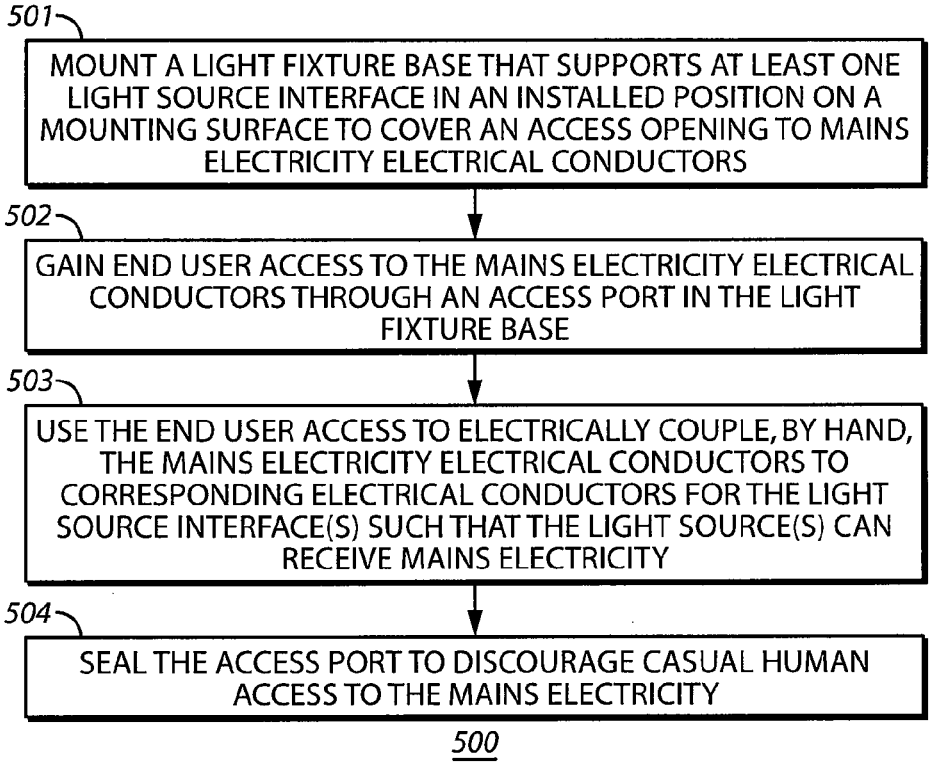
FIG. 5 comprises a flow diagram as configured in accordance with various embodiments of the invention.
Figure 6:
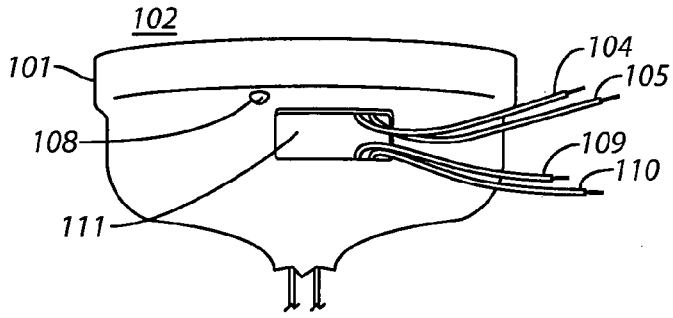
FIG. 6 comprises a perspective view as configured in accordance with various embodiments of the invention.

An illustrative process that is compatible with many of these teachings will now be presented. With reference to FIG. 5, this process 500 provides for mounting 501 a light fixture base 101 that supports at least one light source interface in an installed position on a mounting surface 102 (as shown, for example, in FIG. 6) to thereby cover an access opening (such as the access opening 103 described above with respect to FIG. 1), which access opening serves to provide access to mains electricity electrical conductors 104 and 105. FIG. 6 provides an illustrative view of an installed base as per this step.

Those skilled in the art will note and appreciate that this step of mounting 501 the light fixture base 101 to the mounting surface 102 in a way that covers the access opening to the mains electricity conductors 104 and 105 occurs prior to connecting those conductors 104 and 105 to the light source interface conductors 109 and 110. This sequence of events is notable at least because such a sequence runs contrary to ordinary prior art methodology in this regard.

This process 500 next provides for gaining 502 end user access to the mains electricity electrical conductors 104 and 105 through the access port 111 in the light fixture base 101. By one approach, this can comprise moving the ends of these conductors 104 and 105 beyond the confines of the base 101 in order to simplify subsequent manipulations and connections. By another approach, however, this step can also comprise working with these conductors 104 and 105 completely within the confines of the base 101. This step will accommodate accessing these conductors 104 and 105 by hand and/or by manipulation of a handheld tool such as a screwdriver, a pliers, a tweezers, or the like.

Figure 7:
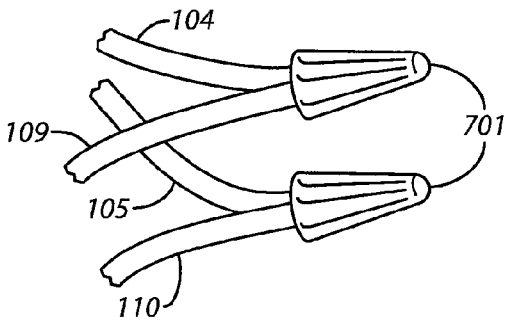
FIG. 7 comprises a detail view as configured in accordance with various embodiments of the invention.
Figure 8:
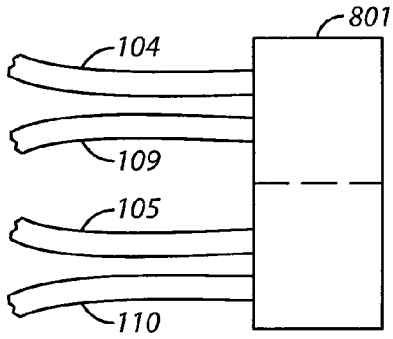
FIG. 8 comprises a detail view as configured in accordance with various embodiments of the invention.

This process 500 then provides for using 503 this end user access to electrically couple, by hand (potentially using a suitable handheld tool such as a needle-nosed pliers, screwdriver, or the like), the mains electricity electrical conductors 104 and 105 to the corresponding electrical conductors 109 and 110 for the light source interface such that the light source interface (and hence the light source) can receive mains electricity. By one approach, and as shown in FIG. 7, this can comprise using wire nuts to electrically couple the mains electricity electrical conductors 104 and 105 to the corresponding conductors 109 and 110, respectively, for the light source interface. By another approach, and as shown in FIG. 8, this can comprise using a wire connector 801 to effect these connections. Such wire connectors are known in the art and are typically configured and arranged to electrically couple pairs of the electrical conductors together by simply inserting the bare conductors into the component. If desired, this wire connector 801, when employed, can be formed integral to the light fixture base 101 and can be located, for example, within the base 101 in an area that is accessible via the access port 111 by use of the installer's hands or a suitable handheld tool such as a needle-nosed pliers.

Figure 9:
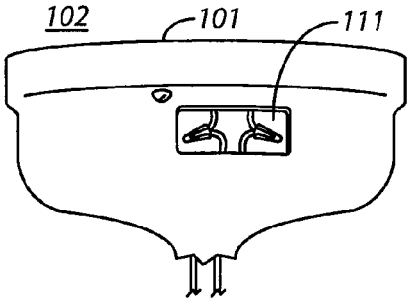
FIG. 9 comprises a perspective view as configured in accordance with various embodiments of the invention.
Figure 10:
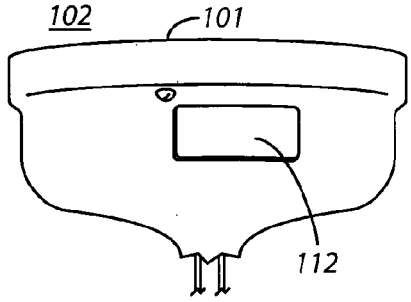
FIG. 10 comprises a perspective view as configured in accordance with various embodiments of the invention.
Figure 11:
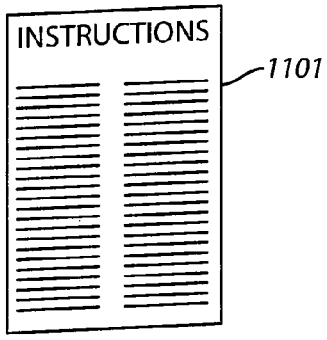
FIG. 11 comprises a top plan view as configured in accordance with various embodiments of the invention.

This process 500 then provides for sealing 504 the access port 111 to thereby discourage casual human access to the mains electricity. Referring to FIG. 9 this can comprise positioning, as necessary, the various conductors 104, 105, 109, and 110 and any corresponding connectors back within the base 101. Referring now to FIG. 10, this step 504 can then comprise using the lockable cover 112 to seal the access port 111. As noted above, this can be achieved using a tool-required or a hands-only-friendly locking mechanism as desired.

To some extent, the very nature and design of a surface-mountable light fixture in accordance with these teachings can suggest to the installer this order of steps and actions. As noted, however, this sequence of steps is highly contrary to ordinary practice in this regard. As a result, it may be useful to provide such a surface-mountable light fixture as a kit that also includes end user instructions that instruct the end user (meaning, in this application setting, the installer) with respect to these actions and their recommended order of being completed.

Figure 12:
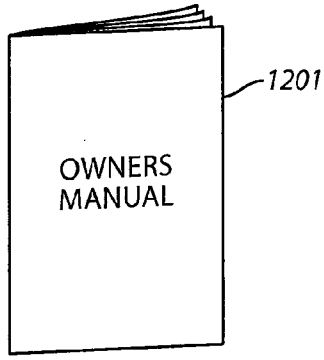
FIG. 12 comprises a perspective view as configured in accordance with various embodiments of the invention.
Figure 13:
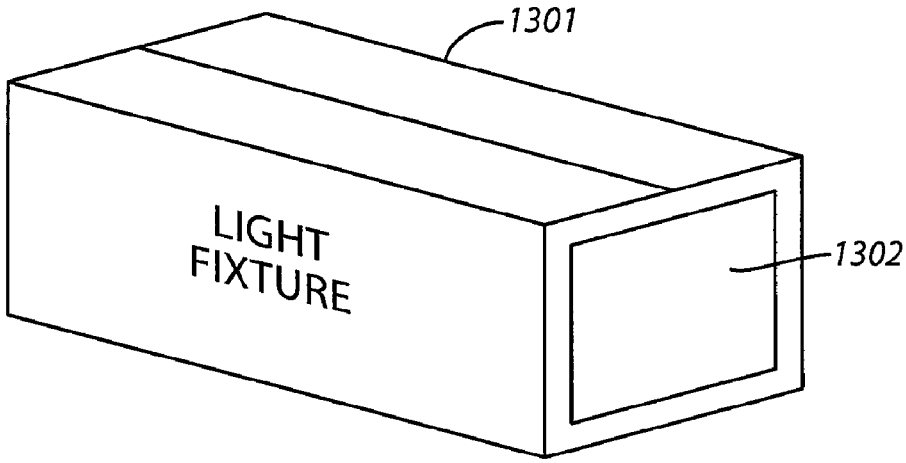
FIG. 13 comprises a perspective view as configured in accordance with various embodiments of the invention.

By one approach, these instructions can comprise a discrete piece of paper (or other such substrate) 1101 having such instructions printed thereon. These instructions can comprise text and/or graphics as desired. By another approach, and referring now to FIG. 12, these end user instructions can comprise at least a part of an owner's manual 1201 (which will be understood to refer, in general, to those printed materials which are often provided in combination with a given product and which provide information regarding the installation, use, and maintenance of the given product and need not necessarily be literally entitled an "owner's manual"). And by yet another approach, and referring now to FIG. 13, these end user instructions 1302 can be presented on a container 1301 (such as a box) that contains the surface-mountable light fixture 100. As yet another approach the user instructions, in whole or in part, can be presented on the fixture itself. The instructions can be either attached to the fixture or embossed on the fixture.

So configured, these teachings provide for a surface-mountable light fixture that can be readily secured in an installed position without first requiring that necessary electrical connections be made. By avoiding this ordinarily required preliminary activity the task of securing the light fixture in an installed position can be greatly eased and facilitated. It will be understood and appreciated that these teachings are readily applied in conjunction with a wide variety of light fixtures, mounting surfaces, and the like. It will also be appreciated that at least certain approaches in these regards are fully compliant with regulatory and legal requirements as pertain, for example, to building codes and the like.

Figure 14:
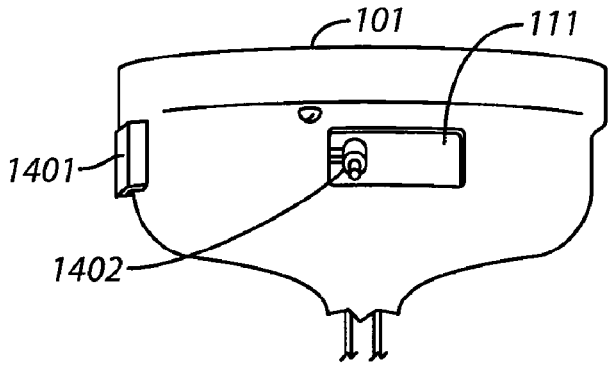
FIG. 14 comprises a perspective view as configured in accordance with various embodiments of the invention.

Those skilled in the art will recognize that a wide variety of modifications, alterations, and combinations can be made with respect to the above described embodiments without departing from the spirit and scope of the invention, and that such modifications, alterations, and combinations are to be viewed as being within the ambit of the inventive concept. As but one example in this regard, and referring now to FIG. 14, when a given light fixture has additional features, components, or functionality such as an animate object detector 1401, an ambient light sensor, or the like, one or more of the controls 1402 (such as a sensitivity setting) for that additional feature, component, or functionality can be positioned within the base 101 such that access to the control 1402 is gained via the access port 111. This will permit such a control (such as, for example, a potentiometer, switch, or the like) to be adjusted and to then protect that control from further unintended adjustments by securing the lockable cover 112 in place.

We claim:

1. A surface-mountable light fixture comprising:

a base that is configured and arranged to be mounted in an installed position on a generally planar mounting surface and create a cavity between the base and the mounting surface, the base having a side wall configured to extend from the mounting surface and a bottom configured to cover an opening in the mounting surface;

at least one light source interface which includes conductors which are configured for connection with mains electricity and which conductors are supported by the base and are contained within the base, the base supporting the light source interface; and the base further including:

an access port comprising a hole in the side wall and which port, when opened while the base is mounted in the installed position, provides access to electrical conductors for the at least one light source interface and to the mains electricity; and a movable cover that is configured to cover and uncover the hole of the access port to provide or deny access to the electrical conductors which are within the cavity formed with mounting of the base to the mounting surface.

2. The surface-mountable light fixture of claim 1 wherein the movable cover is removable and lockable.

3. The surface-mountable light fixture of claim 2 wherein the removable and lockable cover further comprises a tool interface such that the removable and lockable cover can only be manipulated to uncover the access port by use of a corresponding tool.

4. The surface-mountable light fixture of claim 3 wherein the tool interface comprises, at least in part, a threaded member.

5. The surface-mountable light fixture of claim 2 wherein the removable and lockable cover further comprises a hand-manipulable interface such that the removable and lockable cover can be manipulated to cover and uncover the access port by hand.

6. The surface-mountable light fixture of claim 5 wherein the hand-manipulable interface comprises, at least in part, a rotating knob operably coupled to a rotating tab configured to engage the base in a locked configuration and disengage the base in an unlocked configuration.

7. The surface-mountable light fixture of claim 1 wherein the electrical conductors comprise at least two electrically conductive wires for each of the light source interface and the mains electricity.

8. The surface-mountable light fixture of claim 7 wherein the access port is of sufficient size to accommodate the electrical conductors as well as at least two wire nuts that are used to electrically couple pairs of the electrical conductors together.

9. The surface-mountable light fixture of claim 7 wherein the base further comprises integral wire connectors that are configured and arranged to electrically couple pairs of the electrical conductors together.

10. The surface-mountable light fixture of claim 1 wherein the generally planar mounting surface comprises at least one of:

a ceiling;

an interior wall;

an exterior wall;

an exterior eave.

11. The surface-mountable light fixture of claim 2 wherein the removable and lockable cover comprises a seal.

12. The surface-mountable light fixture of claim 11 wherein the seal comprises a weatherproof seal.

13. The surface-mountable light fixture of claim 11 wherein the seal comprises a water resistant seal.

14. The surface-mountable light fixture of claim 11 wherein the seal comprises a waterproof seal.

15. The surface-mountable light fixture of claim 11 wherein the seal comprises at least one of:

an overlap seal;

a face seal;

an interlocking seal.

16. A method comprising:

mounting a light fixture base in an installed position on a generally planar mounting surface to cover an access opening in the generally planar mounting surface and to create a cavity between the mounting surface and the base with installation of the base to the mounting surface and to provide an installed base with mains electricity electrical conductors projecting into the cavity created by the installed base which includes a side wall which has a hole therein, the light fixture base having a movable cover configured to open and close the hole and to permit access to the interior of the cavity created by the base, the light fixture base having a light source interface which is contained at least in part within the light fixture base, the light source interface including light source interface conductors, and the fixture supporting the light source interface;

gaining access to the mains electricity electrical conductors in the cavity through the hole in the side wall of the light fixture base;

accessing the mains electricity electrical conductors in the cavity through the hole;

electrically coupling the mains electricity electrical conductors to the light source interface electrical conductors for the at least one light source interface such that the at least one light source interface can receive mains electricity; and closing the hole with the movable cover to discourage casual human access to the mains electricity.

17. The method of claim 16 wherein the electrically coupling the mains electricity electrical conductors to the light source interface electrical conductors for the at least one light source interface comprises using wire nuts to electrically couple the mains electricity electrical conductors to the light source interface electrical conductors for the at least one light source interface.

18. The method of claim 16 wherein electrically coupling the mains electricity electrical conductors to the light source interface electrical conductors for the at least one light source interface comprises using wire connectors that are formed integral to the light fixture base to electrically couple the mains electricity electrical conductors to the light source interface electrical conductors for the at least one light source interface.

19. The method of claim 16 wherein closing the hole comprises using a tool to close the hole.

20. The method of claim 19 wherein using a tool comprises using a tool to engage and manipulate at least one threaded member.

21. The method of claim 20 wherein the at least one threaded member comprises a screw.

22. The method of claim 16 wherein closing the hole with a moveable cover comprises hand manipulating a hand-manipulable interface to close the hole.

23. The method of claim 22 wherein manipulating the hand-manipulable interface to close the hole comprises, at least in part, rotating a tab into a locking engagement with the base.

24. A kit comprising:

a surface-mountable light fixture comprising:

a base that is configured and arranged to be mounted in an installed position on a generally planar mounting surface and create a cavity between the base and the mounting surface, the base having a sidewall configured to extend from the mounting surface and a bottom configured to cover an opening in the mounting surface;

at least one light source interface configured to be connected to mains electricity and is at least partially within the base, the at least one light source interface supported by the base;

the base further including:

an access port which includes a hole in the sidewall, the hole when open while the base is mounted in the installed position provides access to electrical conductors for the at least one light source interface and to the mains electricity; and a movable cover that is configured to cover and uncover the hole in the sidewall to provide or deny access to the electrical conductors which are within the cavity formed with installation of the base to the mounting surface;

end user instructions instructing an end user to:

mount the light fixture base in an installed position;

access the mains electricity electrical conductors in the cavity through the hole in the side wall of the light fixture base;

electrically couple the mains electricity electrical conductors to the light source interface electrical conductors for the at least one light source interface such that the at least one light source interface can receive mains electricity; and close the access port with the movable cover over the access port.

25. The kit of claim 24 wherein the end user instructions comprise at least a part of a printed owners manual.

26. The kit of claim 24 wherein the end user instructions are presented on a container for the surface-mountable light fixture.

27. The kit of claim 24 wherein the surface-mountable light fixture further comprises a control switch mounted to an interior surface of the base and accessible through the hole of the access port.

28. The surface-mountable light fixture of claim 1 further comprising a control switch mounted to an interior surface of the base and accessible through the hole of the access port.

29. The method of claim 16 further comprising actuating a control switch mounted to an interior of the base through the hole in the sidewall of the base.

* * * * *